US005632046A

United States Patent [19]

Green et al.

[11] Patent Number: 5,632,046

[45] Date of Patent: May 27, 1997

[54] SELF-ADJUSTING, FABRIC-COVERED SWEAT BAND FOR A HAT

[76] Inventors: Lawrence Green; Louise E. Green, both of 1453 12th St., Santa Monica, Calif. 90401

[21] Appl. No.: 365,359

[22] Filed: Dec. 27, 1994

[51] Int. Cl.[6] ..... A42B 1/22

[52] U.S. Cl. ..... 2/183; 2/175.1; 2/181; 2/184; 2/DIG. 11

[58] Field of Search ..... 2/171, 175.1, 181, 2/183, 184, 195.1, 195.2, 195.3, 417, 418, DIG. 11

*Primary Examiner*—Diana Biefeld
*Attorney, Agent, or Firm*—W. Edward Johansen

[57] ABSTRACT

A self-adjusting, fabric-covered sweat band for a hat including a crown having a base of an inner circumference, includes an elastic material which has a length of a first dimension, which is shorter than the inner circumference of the base of the crown of the hat, and a width of a second dimension and which has a front edge, rear edge, a first edge and a second edge running lengthwise and a fabric material which has a length of a third dimension, which is longer than the circumference of the inner base of the crown of the hat, and a width of a fourth dimension, which is greater than four times the second dimension and which has been folded over along a lengthwise centerline. The elastic material is encased in the folded over fabric material with the first edge of the elastic material being adjacent and contiguous to the lengthwise centerline and stitches in the fabric material, which are adjacent and contiguous to the second edge of the elastic material, secure it so that the remainder of the folded over fabric material is stitched to the base.

2 Claims, 1 Drawing Sheet

SELF-ADJUSTING, FABRIC-COVERED SWEAT BAND FOR A HAT

BACKGROUND OF THE INVENTION

The field of the invention is self-adjusting, fabric-covered sweat bands for a hat.

U.S. Pat. No. 4,833,734 teaches a low cost sweat band which is formed of an elastic fabric core of a length to resiliently encircle the head and a low strength, highly absorbent paper fabric cover of excess length which is gathered into a cushioning, absorbent pad by stitching onto the elastic fabric.

U.S. Pat. No. 4,856,116 teaches a sweat band which has a first component for absorbing copious quantities of perspiration from a user's skin and a second component for holding the first component against that part of the user's body from which perspiration is to be adsorbed. The moisture absorbing component has a core of moisture absorbent material covered with a soft, pliable material which will be comfortable to the user and will efficiently promote the absorption of moisture from the user's skin and the transfer of that moisture to the absorbent core. The second component of the sweat band includes an elongated, elastically extensible member with the ends thereof fixed to opposite ends of the first sweat band component.

U.S. Pat. No. 4,274,157 teaches a ventilated hat which has an adjusting band. The adjusting band is preferably formed as a moisture absorbent sweat band and extends along the inside of the primary band structure of the hat, in spaced relation thereto to allow circulation of air upwardly and downwardly through a gap between the two bands. At least one and preferably both of the ends of the adjusting band are connected to the primary band structure for relative longitudinal adjusting movement in a relation varying the effective size of the hat.

U.S. Pat. No. 4,393,519 teaches a head band which includes an absorbent material and an elastic material. The head band encircles the head of the user and absorbs sweat.

U.S. Pat. No. 4,941,210 teaches a quick-change sweat band which is designed to be comfortable. The quick-change sweat band is attached to the existing sweat band manufactured in a cap or other head-wear. Primarily, it consists of a loop pile fastener adhered permanently to the existing sweat band, and a hook pile fastener is similarly secured to an absorbent band for engagement with the loop pile fastener. The combination of the hook pile fastener and the pad are quickly removed for replacement and washing when needed, and prevents odors from perspiration in the cap visor and the existing sweat band.

U.S. Pat. No. 5,025,504 teaches a liner for head coverings including helmets, hats and caps which has a body with a central section and tapered end sections. The body includes absorbing material and is releasably secured to the head covering for easy replacement. The liners are typically disposable and may be formed with a core of thermoplastic containing other fibers sandwiched between facing and backing sheets. The edges and transverse section of the body may be densified.

U.S. Pat. No. 5,058,210 teaches a disposable sweat liner for a safety hat which provides comfort and safety. The disposable sweat liner is composed of layers of absorbent padding which is covered on the top and bottom with fabric. A pressure-sensitive adhesive tab attaches the disposable sweat liner to the safety hat.

U.S. Pat. No. 5,088,126 teaches a disposable liner which is to be placed inside a head covering so as to be in direct contact with a wearer's forehead. The disposable liner is formed of an absorbent material such as terry cloth which has a pressure-sensitive adhesive on one side thereof.

U.S. Pat. No. 5,046,196 teaches a cap which has a cover, a bill, a two-part adjustable band with standard adjustment apertures and fittings and a liner. The liner is attached to the base of the cover by the complementary fastners which are sold and marketed under trademark "VELCRO."

SUMMARY OF INVENTION

The present invention is directed to a sweat band for a hat which includes a brim and crown which has a base.

In a first separate aspect of the invention the sweat band is self-adjusting and includes an elastic material.

In a second separate aspect of the invention the sweat band is fabric-covered and includes a fabric material which is attached to the base.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENT

Figure 1:
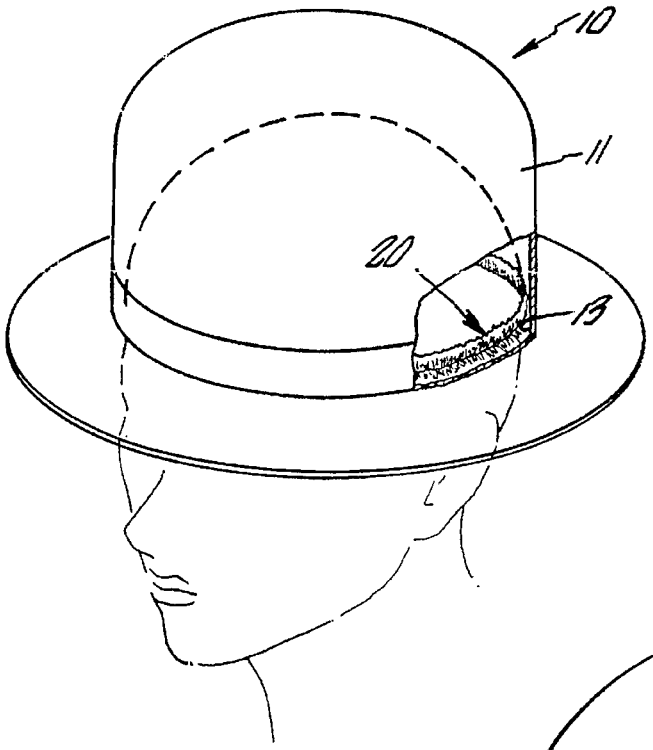
FIG. 1 is a perspective drawing in partial cross-section of a hat which includes a crown, a brim and a self-adjusting, fabric-covered sweat band according to the present invention.
Figure 2:
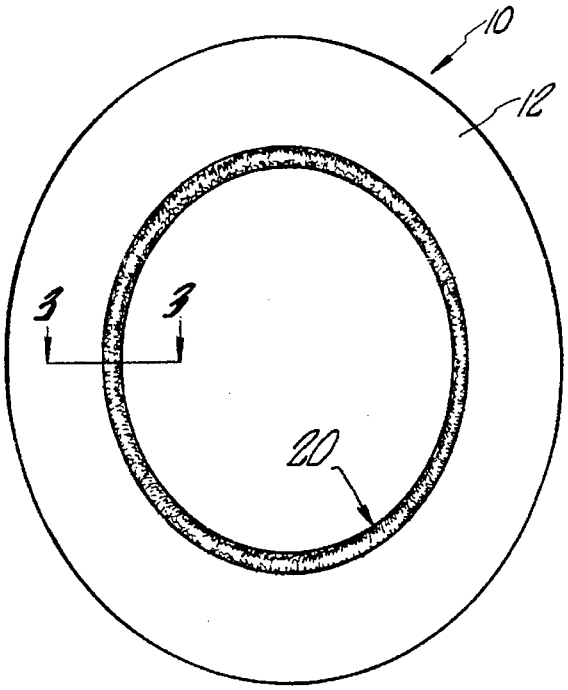
FIG. 2 is a bottom plan view of the hat of FIG. 1.

Referring to FIG. 1 in conjunction with FIG. 2 a hat 10 includes a crown 11 and a brim 12. The crown 11 has a base 13 having an inner circumference. In a specific embodiment the inner circumference is 24 inches. The unfinished or blocked hat 10 is generally formed out of either felt or straw. The hat 10 may not include a brim; the hat 10 may include only the base of the crown 11.

Figure 3:
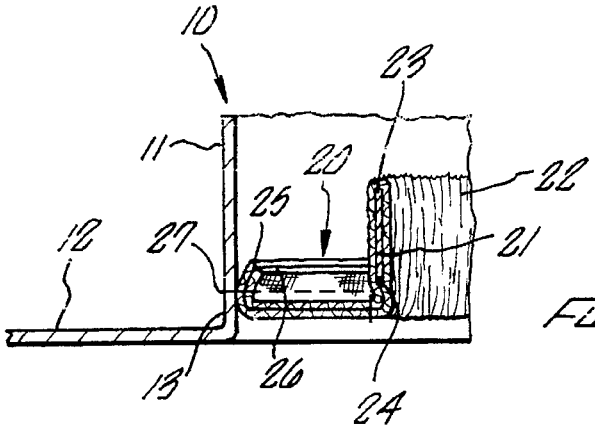
FIG. 3 is a partial elevation view of the hat of FIG. 1 taken along line 3—3 of FIG. 2.

Referring to FIG. 3 in conjunction with FIG. 1 and FIG. 2 a self-adjusting, fabric-covered sweat band 20 includes an elastic material 21 and a fabric material 22. The elastic material 21 has a length of a first dimension, which is smaller than the inner circumference of the base 13, and a width of a second dimension. The elastic material 21 has a front end, a rear end, a first edge 23 and a second edge 24 running lengthwise. The front end and the rear end lap over each other and are stitched together into a first circle. In a specific embodiment the length of the elastic material 21 is 19 inches and the width of the elastic material 21 is ½ inch. The circumference of the first circle which is formed by the stitched together elastic material 21 is 18¾ inches. The fabric material 22 may be selected from a group consisting of silk, cotton, synthetic polymers and blends thereof. The fabric material 22 has a length of the third dimension, which is larger than the inner circumference of the base 13, and a width of a fourth dimension, which is greater than four times the second dimension. The fabric material 22 has a front end, a rear end, a first edge 25 and a second edge 26 running lengthwise. The front end and the rear end are stitched together into a second circle. In the specific embodiment the length of the fabric material 22 is 27 inches and the width of the fabric material 22 is 3 inches. The circumference of the second circle which is formed by the stitched together fabric material 22 is 26½ inches. The fabric material 22 is folded over along a lengthwise centerline. The elastic material 21 is encased in the folded over fabric material 22 with the first edge 23 of the elastic material 21 being adjacent and contiguous to the lengthwise centerline. Stitches 27 in the fabric material 22, which are adjacent and contiguous to the second edge 24 of the elastic material 21, secure it within. The remainder of the folded over fabric material 22 is attached to the base 13.

The unique composition of the elastic material 21 and the fabric material 22 and the method of fabricating and attaching self-adjusting, fabric-covered sweat band 20 to the base 13 creates a hat 10 which fits a range of head sizes, which is light and comfortable and which is firmly secured on the head of the wearer. In the specific embodiment the head size of the hat 10 ranges from 19 inches to 23¼ inches.

From the foregoing it can be seen that a self-adjusting, fabric-covered sweat band for a hat has been described. It should be noted that the sketches are not drawn to scale and that distance of and between the figures are not to be considered significant. Accordingly it is intended that the foregoing disclosure and showing made in the drawing shall be considered only as an illustration of the principle of the present invention.

What is claimed is:

1. A combination self-adjusting, fabric-covered sweat band and hat, said combination self-adjusting, fabric-covered sweat band and hat comprising:

a. a hat including a crown having a base with an inner circumference;

b. an elastic material having a length of a first dimension, which is shorter than said inner circumference of said base of said crown of said hat, and a width of a second dimension, said elastic material having a first edge and a second edge running lengthwise; and c. a fabric material having a length of a third dimension, which is longer than said inner circumference of said base of said crown of said hat, and a width of a fourth dimension, which is greater than four times said second dimension, whereby said fabric material has been folded over along a lengthwise centerline and whereby said elastic material is encased in said folded over fabric material with said first edge of said elastic material being adjacent and contiguous to said lengthwise centerline and stitches in said fabric material, which are adjacent and contiguous to said second edge of said elastic material, secure said elastic material so that the remainder of said folded over fabric material is stitched to said base of said crown of said hat.

2. The combination self-adjusting, fabric-covered sweat band and hat according to claim 1 wherein said fabric material may be selected from a group consisting of silk, cotton, synthetic polymers and blends thereof.

* * * * *